United States Patent [19]

Vallett et al.

[11] Patent Number: 4,793,800

[45] **Date of Patent: * Dec. 27, 1988**

[54] GAS WATER HEATER/BOILER

[75] Inventors: William L. Vallett, Old Hickory; Mohsen Sarfehjoo, Nashville, both of Tenn.

[73] Assignee: Lochinvar Water Heater Corporation, Nashville, Tenn.

[ * ] Notice: The portion of the term of this patent subsequent to Feb. 9, 2005 has been disclaimed.

[21] Appl. No.: 83,515

[22] Filed: Aug. 7, 1987

Related U.S. Application Data

[63] Continuation of Ser. No. 824,168, Jan. 10, 1986, Pat. No. 4,723,513.

[51] Int. Cl.[4] ..... F23D 14/12

[52] U.S. Cl. ..... 431/328; 122/14; 122/18; 239/553.3; 239/567

[58] Field of Search ..... 239/555.3, 557, 567; 431/328, 329, 326; 122/14, 18, 19, 333, 362; 126/350 R

[56] References Cited

U.S. PATENT DOCUMENTS

| | | | |
|---|---|---|---|
| 1,116,912 | 11/1914 | Parisen | 239/553.3 |
| 3,204,683 | 9/1965 | Ruff et al. | 431/329 X |
| 3,324,924 | 6/1967 | Hailstone et al. | 431/328 |
| 3,445,175 | 5/1969 | Krieger | 431/328 |
| 3,601,320 | 8/1971 | Du Plessis | 239/553.3 |
| 4,140,100 | 2/1979 | Ishihara | 431/328 X |
| 4,445,464 | 5/1984 | Gerstmann et al. | 122/18 X |
| 4,473,034 | 9/1984 | Raudabaugh et al. | 122/18 |

*Primary Examiner*—Edward G. Favors

*Attorney, Agent, or Firm*—Harness, Dickey & Pierce

[57] ABSTRACT

There is disclosed a gas-fired water heater/boiler apparatus with a unique burner assembly that provides high levels of BTU/hour input making it suitable for commercial installations. The gas burner includes a pair of superimposed tubes, each having evenly distributed perforations of a different uniform size, that are rolled flush together and provide a thick walled burner with greatly increased strength and resistance to premature failure while furnishing an optimum flame pattern. The gas burner projects into the interior of a vertical, cylindrical array of finned heat exhanger tubes through which the fluid to be heated is circulated. The water heater/boiler apparatus is compact and thermally insulated by a pressurized forehearth and may be installed on combustible floors or in closets with zero clearance.

15 Claims, 3 Drawing Sheets

GAS WATER HEATER/BOILER

This is a continuation of U.S. patent application Ser. No. 824,168, filed Jan. 10, 1986, U.S. Pat. No. 4,723,513.

BACKGROUND AND SUMMARY OF THE INVENTION

The present invention relates to gas fired apparatus for heating water and more particularly to a gas water heater/boiler comprising a cylindrical array of finned heat exchanger tubes into which penetrates a tubular gas burner for heating water or other fluid passing through the tubes.

The heat exchanger tubes are located vertically in the center of a cubical sealed casing which in turn is located inside a second sealed casing which forms the external body of the heating apparatus. The sealed space or forehearth separating the casings forms a passageway for fresh combustion air which ensures a very efficient thermal insulation of the heater. A blower is mounted within the forehearth which pressurizes the apparatus with fresh combustion air and thereby prevents any possible leak or circulation of combustion products.

The water heater/boilers of the present invention are designed for water pressure up to 160 pounds per square inch and a water temperature of 250 degrees Fahrenheit, thus making them suitable for commerical installations including swimming pool heater applications. The design permits indoor or outdoor installation. Due to the insulating effect of the sealed forehearth the water heater/boiler may be installed in a closet with combustible flooring or against closet walls with zero clearance and it can draw fresh air for combustion from outside or within the closet. The input range of the water heater/-boiler, depending upon the particular size or model, is from approximately 250,000 BTU per hour to approximately 1,000,000 BTU per hour. However, the principles disclosed herein may be utilized for water heater/-boilers having substantially smaller or greater BTU input levels.

One of the shortcomings of prior known water heater/boiler apparatus has been burner failure. In order to obtain high BTU input, high levels of heat from the burner are required. Excessive heat, however, frequently causes cracks, and hence failure, in metal tubular burners.

Another problem associated with conventional water heater/boiler systems is condensation of the flue products on the heater exchanger tubes and corrosion that is associated therewith.

A still further problem experienced by known water heater/boilers is the formation of mineral deposits on the inside of the heat exchanger tubes (also known as scaling or liming).

A still further problem of conventional water heater/boilers is heat loss and a resultant less than desirable thermal efficiency which translates into higher operating costs.

It is therefore desirable to provide a burner assembly for a gas fired water heater/boiler apparatus in which the burner is reinforced and the flame does not contact the outer surface of the burner assembly thereby ensuring cooler burner operation, longer burner life, and prevention of cracks or other premature failure of the burner.

It is also desirable to provide a water heater/boiler apparatus in which the temperature of the combustion byproducts upon passing through the heat exchanger tubes is above the dew point thereby reducing the likelihood that condensation will occur on the heat exchanger tubes.

It is further desirable to provide a water heater/boiler apparatus in which the fluid to be heated travels through the heat exchanger tubes at a velocity sufficient to minimize liming of the tubes.

It is still further desirable to provide an insulated water heater/boiler apparatus that operates at high levels of thermal efficiency.

Additional objects and features of the present invention will become apparent from the subsequent description and appended claims taken in conjunction with the accompanying drawings.

BRIEF DESCRIPTION OF THE DRAWINGS

FIG. 9 is a diagrammatic illustration of a side elevational view, partially in cross section, of the water heater/boiler apparatus of the present invention.

DETAILED DESCRIPTION OF THE PREFERRED EMBODIMENTS

Figure 1:
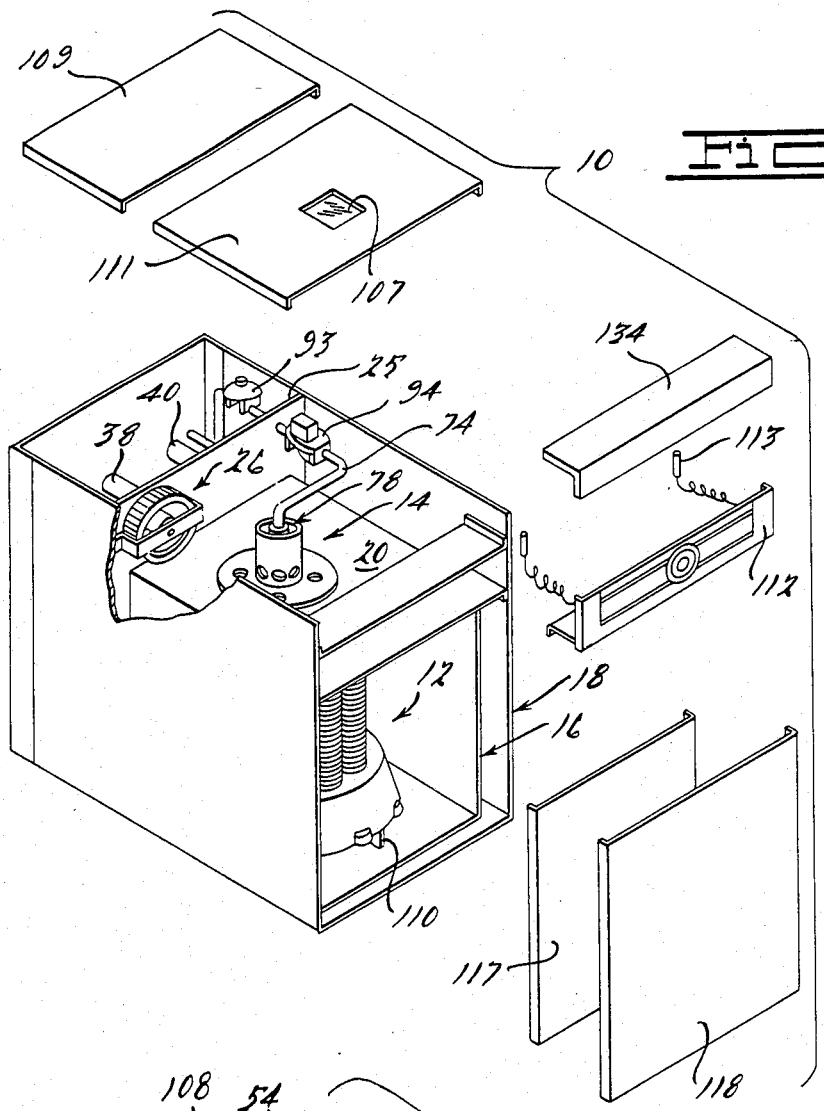
FIG. 1 is an exploded perspective view, partially broken away, of the water heater/boiler apparatus of the present invention.

Referring now to the drawings the water heater/-boiler apparatus in accordance with the present invention is shown in FIG. 1 at 10. The water heater/boiler apparatus 10 (hereinafter "heater 10") includes a heat exchanger unit 12, a burner assembly 14, an inner sealed casing 16, and an outer sealed casing 18. Heat exchanger unit 12 and burner assembly 14, as will be described below, are shown in greater detail in FIGS. 2 and 3, respectively.

As shown in FIGS. 1 and 9, heat exchanger unit 12 is situated vertically in the center of inner sealed casing 16 which in turn is situated inside an outer sealed casing 18. Inner sealed casing 16 has an inner casing top 20 which has an opening 22 located therein. Between inner casing 16 and outer casing 18 is a sealed space or forehearth 24 which is divided by a forehearth wall 25 into a first forehearth 27 and a second forehearth 29.

Situated over an opening 31 in forehearth wall 25 is an air intake means 26 which causes fresh combustion air to be brought into forehearth 24 by way of an air inlet 33. Air intake means 26 may comprise a blower, fan, or other suitable device which draws fresh combustion air through air inlet 33 into first forehearth 27 and through opening 31 in forehearth wall 25, thereby injecting the combustion air into second forehearth 29. As a result forehearth 24 is pressurized; i.e. a negative pressure is created in first forehearth 27 and a positive pressure is created in second forehearth 29. In this manner pressurized forehearth 24 will prevent any combustion products within inner casing 16 from leaking outside heater 10.

Figure 2:
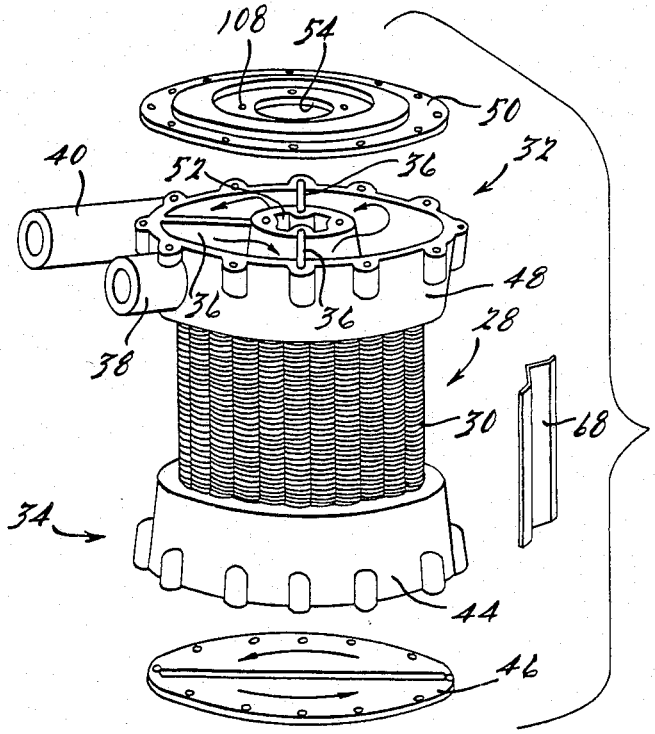
FIG. 2 is an exploded perspective view of the heat exchanger unit of the water heater/boiler apparatus.

Heat exchanger unit 12 is comprised of a circular array of vertical heat exchanger tubes 28 as shown in FIG. 2. Tubes 28 can be made of copper or any other suitable material that is durable and provides high levels of heat conductivity. Tubes 28 include a pluralty of integral fins 30 that surround tubes 28 and serve to enlarge the surface area of tubes 28 to which heat from the combustion products is transferred. Tubes 28 are connected at their upper ends to an upper header 32 and at their lower ends to a lower header 34. Upper and lower headers 32 and 34 are circular in configuration and each having internal transverse baffles 36 which direct the fluid to be heated to circulate through a portion of tubes 28 to the opposite header. Transverse baffles 36 are offset with respect to headers 32 and 34 such that the fluid is circulated in a different bank of tubes 28 past burner assembly 14 a total of four times. This four-pass system maximizes the heating potential per unit length of heat exchanger unit 12. The arrows in FIG. 2 and in tubes 28 in FIG. 9 show the direction of the fluid through heat exchanger unit 12.

Upper header 32 is provided with an inlet 38 for the water or other fluid to be heated to enter header 32. After the fluid makes its four-pass circulation through heat exchanger unit 12, it exits through an outlet 40 which is also provided on upper header 32. As shown in FIGS. 1 and 9, inlet 38 and outlet 40 may further comprise short pipe lengths which pass through forehearth wall 25 and outer sealing casing 18 with seals (not shown).

Connected to inlet 38 is a fluid pump 42 that circulates the fluid to be heated through tubes 28 of heat exchanger unit 12. Pump 42 is designed to circulate the fluid at a velocity of approximately eight feet per second through each tube 28. This velocity has been found to be useful in preventing lime and other minerals from forming or collecting on the inner surface of tubes 28. In this manner the life of heat exchanger unit 12 is enhanced. At a velocity of eight feet per second, it has been found that a particle content of up to 25 grains of dissolved solids per gallon of water (which is higher than fluid particle contents encountered by the majority of domestic water heater/boiler applications) will remain in suspension. When heater 100 is utilized in systems where liming or scaling is not a problem and the system has its own pump, for instance in boiler and swimming poor heater applications, pump 42 may be eliminated.

Lower header 34 comprises a lower manifold 44 and a lower manifold plate 46 that is attached to (with fasteners not shown) and sealingly engages lower manifold 44 and transverse baffle 36 to provide a fluid tight heater compartment for receiving fluid to be heated from a portion of tubes 28 and circulating the fluid into another portion of tubes 28. Upper header 32 comprises an upper manifold 48 and an upper manifold plate 50 that is attached to (with fasteners now shown) and sealingly engages upper manifold 48 and transverse baffles 36 to circulate the fluid as recited above. Uppe manifold 48 and upper manifold plate 50 are provided with first and second burner ports 52 and 54, respectively. Burner ports 52 and 54 provide an opening in upper header 32 through which burner assembly 14 can be inserted into heat exchanger unit 12. Upper and lower manifolds 48 and 44 also include a plurality of tube openings 56 for receiving the ends of heat exchanger tubes 28 in a fluid tight fashion. To resist the combined effects of corrosion and high temperature the insides of upper and lower headers 32 and 34 are coated with a protective material. Headers 32 and 34 may be constructed of cast iron or any other suitable material.

As shown in FIG. 9, heater 10 comprises several distinct zones. Fresh combustion air is brought from outside heater 10 into a first or forehearth zone 58 to pressurize the heater. From there, the combustion air is mixed with gas in a second or mixing zone 60 inside burner assembly 14. The air/gas mixture then ignites outside the burner tube in a third or combustion zone 62 between burner assembly 14 and tubes 28. Finally, the combustion products pass through the array of heat exchanger tubes 28 into a fourth or flue products zone 64 between tubes 28 and inner sealed casing 16. In fourth zone 64 the pressure created by air intake means 26 pushes the flue products downward where they are caused to exit heater 10 through a flue outlet 66. The path of movement of the combustion air products through these zones is depicted by the arrows in FIG. 9.

Figure 8:
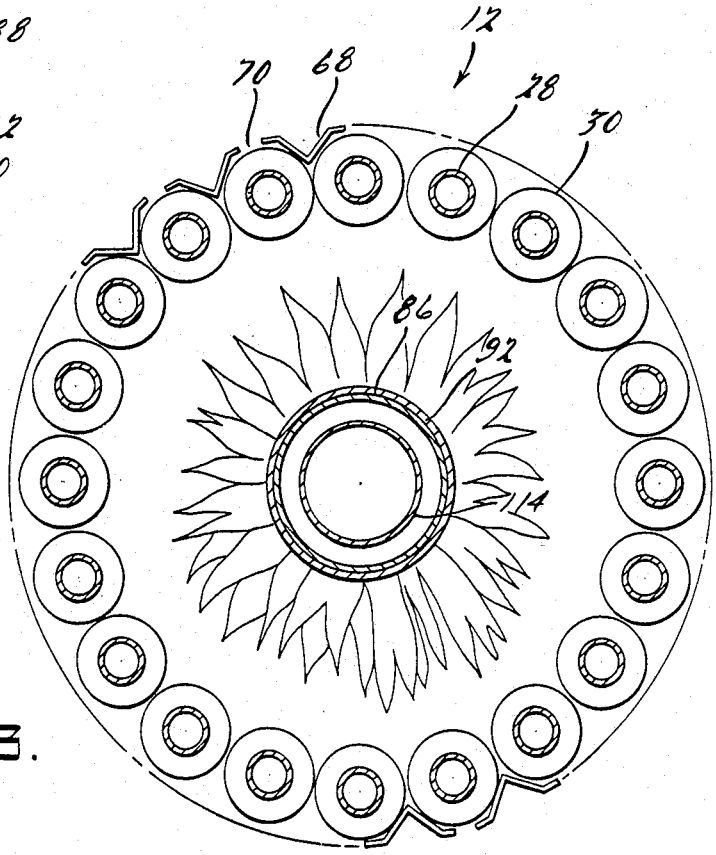
FIG. 8 is a diagrammatic illustration of a cross section taken through the heat exchanger unit of the water heater/boiler apparatus with the burner in place.

As shown in FIGS. 2 and 8 the circular array of heat exchanger tubes 28 is provided at its radially outermost portion with a plurality of baffles 68 which are substantially V-shaped in cross-section. Baffles 68 partially enclose tubes 28 and fins 30 throughout their length while leaving vertical slots 70 which permit communication between third zone 62 and fourth zone 64. This arrangement provides prolonged circulation of the heat from the combustion products around fins 30 and optimizes the transfer of combustion heat to the fluid in tubes 28.

Figure 3:
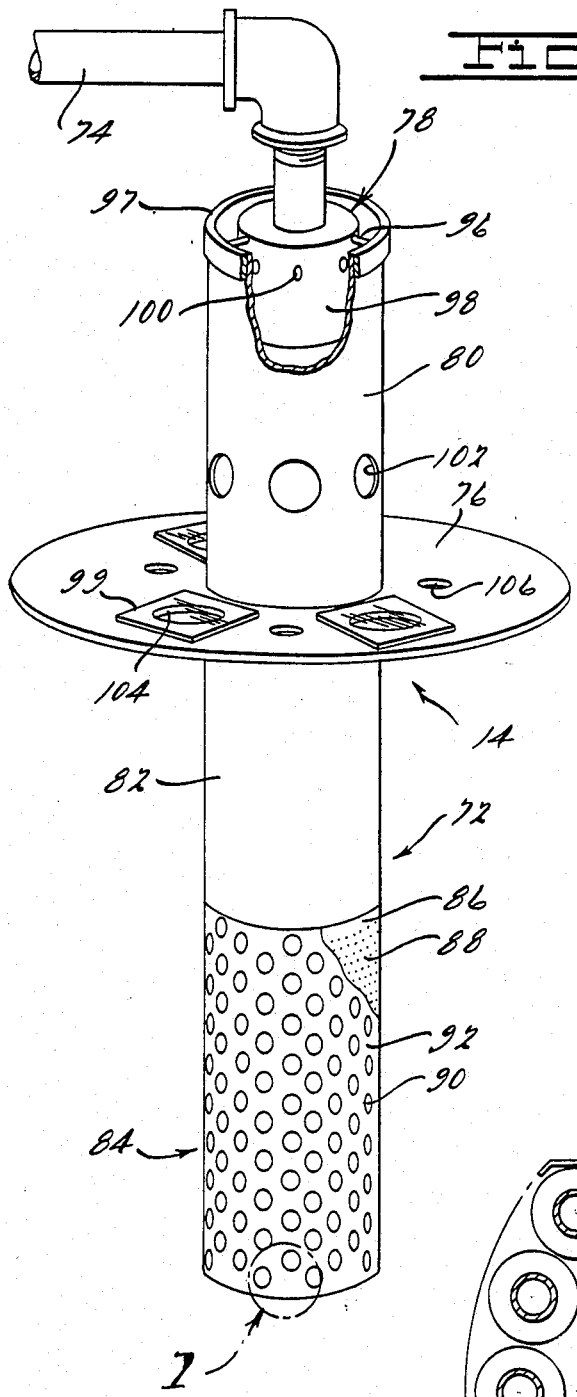
FIG. 3 is a perspective view, partially broken away, of a first embodiment of the burner of the water heater/-boiler apparatus.

In FIG. 3, a first embodiment of burner assembly 14 is shown which comprises a burner tube 72, a support collar 76, an orifice 78, and a gas supply line 74. Burner tube 72 includes a venturi portion 80, a mixing portion 82, and a burner portion 84. Burner portion 84 extends for a length substantially equivalent to that of the heat exchanger tubes 28 of the particular model of heater 10 for which burner assembly 14 is to be used.

Figure 7:
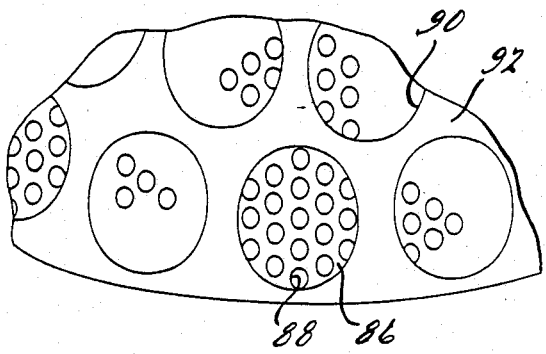
FIG. 7 is an enlarged view of the area designated with the numeral "7" in FIG. 3 showing the burner perforations of the present invention.

Burner portion 84 is comprised of an inner perforated tube 86 and an outer perforated tube 92. As shown in FIGS. 3 and 7, inner perforated tube 86 has a plurality of first perforations 88 which are regularly and uniformly spaced around the circumference and length of inner perforated tube 86. First perforations 88 have uniform size of approximately 0.038 inches in diameter and are spaced such that inner perforated tube 86 has an open area of approximately 45%. Outer perforated tube 92 has a plurality of second perforations 90 which are regularly and uniformly spaced around the circumference and length of outer perforated tube 92. Second perforations 90 have a uniform size of approximately 0.265 inches in diameter and are spaced such that outer perforated tube 92 has an open area of approximately 65%. Inner and outer perforated tubes 86 and 92 are rolled flush together so that there is essentially no gap between the tubes. Tubes 86 and 92 are welded or attached in any other suitable fashion to mixing portion 82 of burner tube 72. The bottom of perforated tubes 86 and 92 is closed off with a cap that is also welded or otherwise suitably attached.

It has been discovered that utilizing separate burner tubes with the open areas described above gives a resultant open area for burner portion 84 of approximately 29% when outer perforated tube 92 is superimposed over inner perforated tube 86. While the size of first perforations 88 is ideal for combustion and flame size, second perforations 90 randomly close off a portion of first perforations 88 and therefore decrease the flame distribution pattern so there will not be too much heat per linear foot of heat exchanger tubes 28. The superimposing of inner and outer perforated tubes 86 and 92 greatly enhances the strength of burner assembly 14. In prior art water heater/boiler apparatus, the gas burner assemblies have tended to have a shorter useful life in comparison to the rest of the apparatus. This shorter life was due in part to the fact that perforations of a sufficiently small size and number to give good flame and heat characteristics could not be economically made in a thick walled burner tube. Therefore, thinner walled burner tubes were utilized in which cracks and premature failure would result.

When burner assembly 14 is assembled into heater 10, burner portion 84 of burner tube 72 extends downward into the central portion of heat exchanger unit 12 through opening 22 of inner casing 20 and through first and second burner ports 52 and 54 of header 32. Support collar 76, which extends radially outward from burner tube 72 between venturi portion 80 and mixing portion 82, rests on inner casing top 20 and upper header 32 to support burner assembly 14 when the burner assembly is positioned in heat exchanger unit 12. A plurality of small collar holes 106 are provided in support collar 76 for attaching (with fasteners not shown) collar 76, and hence burner assembly 14, to upper header 32 which has a plurality of corresponding attachment holes 108. The burner assembly is thus easily removable from heater 10 when necessary for cleaning or other maintenance.

Referring now to FIGS. 3 and 9, orifice 78 is attached to a gas supply line 74 that passes through outer sealed casing 18 and forehearth wall 25. Gas supply line 74 includes a gas cock 91, a gas pressure regulator 93, and a main gas valve 94 that is wired in series with an air proving switch, an operating control, a temperature limiting switch, and a fluid flow proving switch for maximum control and safe operation of heater 10. Gas line 74 comprises whatever elbows or other joints are necessary to enable orifice 78 to be positioned in the open top of venturi portion 80 of burner tube 72. Orifice 78 is held in proper position in venturi portion 80 by a plurality of brackets 96 that are attached to orifice 78 and to a rim 97 that encircles the open top of burner tube 72.

Orifice 78 comprises a closed cylindrical body 98 which has a threaded opening at its top for attachment to gas line 74. Body 98 has a plurality of orifice apertures 100 situated in a circumferential row near the upward end of body 98. Since body 98 is closed at its downward end, gas which enters body 98 through supply line 74 must exit orifice 78 through apertures 100 thereby causing turbulence in venturi portion 80 and mixing portion 82 of burner tube 72 which promotes the mixture of gas with fresh combustion air from the pressurized sealed forehearth 24. The fresh combustion air enters venturi portion 80 and mixing portion 82 through the open top of burner tube 72 and through a series of venturi openings 102 located in the wall of venturi portion 80 between orifice 78 and support collar 76. Orifice 78, venturi portion 80, and mixing portion 82 thus provide an evenly mixed mixture of air and gas mixture that enters burner portion 84 of burner assembly 14.

Support collar 76 also includes a plurality of observation ports 104 that are each covered with a heat resistant glass slide 99 for visually monitoring the burner flame and general operation of burner assembly 14. As shown in FIG. 1, a first removable panel 109 of outer sealed casing 18 provides access int first forehearth 27 and a second removable panel 111 of outer sealed casing 18 provides access to second forehearth 29, burner assembly 14, and heat exchanger unit 12. To assist the visual monitoring of the burner flame a glass panel 107 is provided in second removable panel 111. A pilot or hot surface igniter 105 located near the outer surface of burner portion 84, shown in FIG. 9, provides the ignition necessary to begin combustion.

Due to the configuration of heater 10, the fresh combustion air in first zone 58 is preheated prior to mixing with the fuel gas in second zone 60. This preheating, which results in higher combustion efficiency, is accomplished by passing the fresh combustion air in forehearth 24 in heat exchange relationship with the hot flue gases in fourth zone 64.

The pressure of the air/gas mixture inside burner tube 72 is precisely metered by a combination of air intake means 26 and the pressure of gas supply line 74 to be approximately 0.2 inches of water column ("inches WC"). This pressure works in combination with the size of first perforations 88 in inner perforated tube 86 to prevent the flame from burning on the outer surface of burner portion 84 of burner tube 72. Accordingly, the temperature of inner and outer perforated tubes 86 and 92 during combustion will not exceed the temperature of the premixed air/gas mixture plus some radiation (i.e. a maximum of approximately 180 degrees Fahrenheit). This control of the temperature of the burner's perforated portion greatly enhances overall burner life and has been found to provide safe operation of heater 10 under abnormal conditions such as a partially blocked flue outlet or a downdraft condition.

Figure 4:
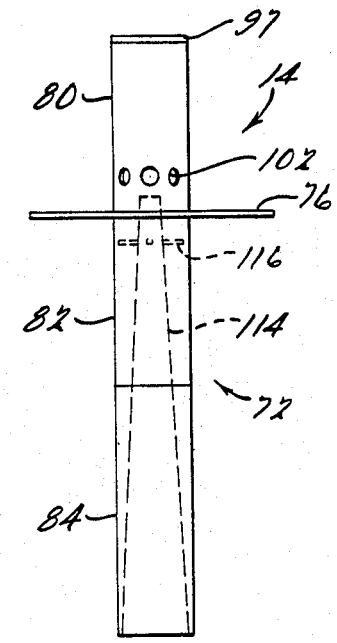
FIG. 4 is an elevational view of the burner shown in FIG. 3.

As shown in FIG. 4, the burner assembly 14 of FIG. 3 also comprises a cone 114 (shown in phantom) situated inside of burner tube 72 to ensure that an air/gas mixture of approximately 0.2 inches WC will be uniformly distributed all around and along the length of burner portion 84. Cone 114 thus compensates for the pressure drop that naturally occurs along the length of a perforated burner tube. Cone 114 sits on the end cap of burner tube 72 and has a plurality of spacer pins 116 near its upward end to maintain concentricity with respect to burner tube 72.

The embodiment of burner assembly 14 that is shown in FIG. 3 will, due to the air/gas mixture and velocity (described below) and burner perforation size, provide a given input of BTU's per square inch of air/gas mixture input. With regard to burner assembly 14 for various models or input ratings of heater 10, the perforated material of burner portion 84, the diameter of burner tube 72, and input (which is BTU per square inch of air/gas mixture) is kept the same. In order to accommodate different input BTU levels for different heater 10 models, the length of burner portion 84 is generally all that is changed. For example, a heater 10 model which has an input of approximately 250,000 BTU per hour will have a burner portion 84, a mixing portion 82, and a venturi portion 80 all approximately 6 inches long. Cone 114 of the 250,000 BTU model is approximately 15 inches high with bottom and top diameters of approximately 3¼ inches and 1¾ inches, respectively. For a heater 10 model with approximately 500,000 BTU per hour input, the only difference in burner assembly 14 is that burner portion 84 is approximately 12 inches long and cone 114 is approximately 21 inches high.

Figure 5:
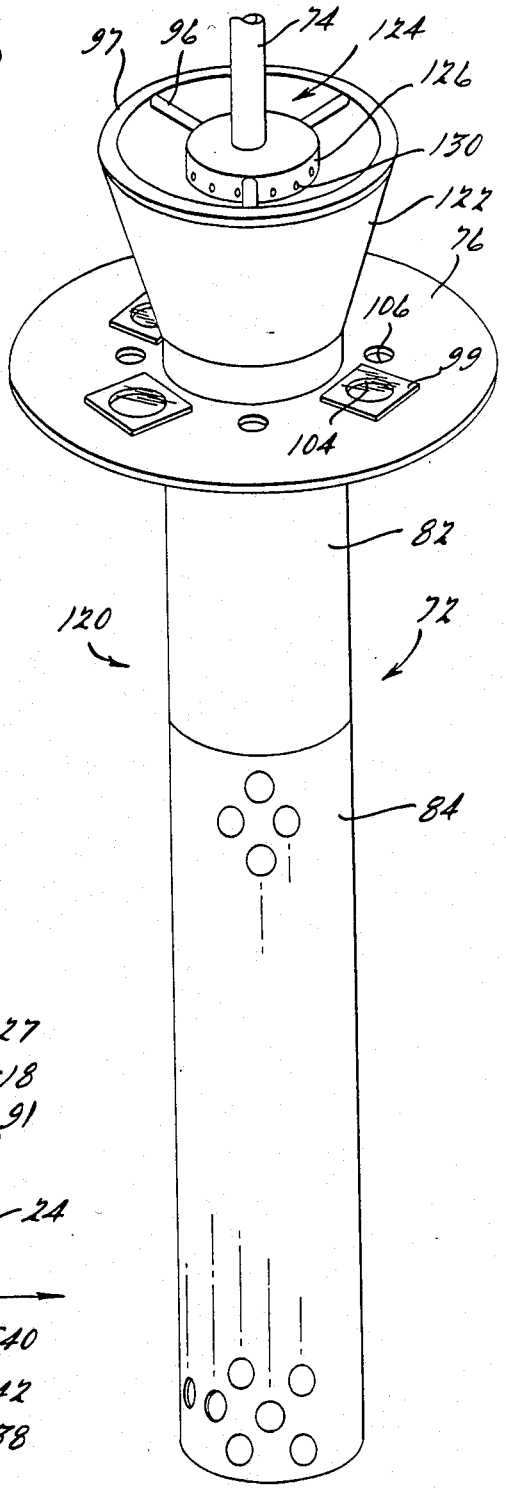
FIG. 5 is a perspective view, partially broken away, of a second embodiment of the burner of the water heater/boiler apparatus.
Figure 3:
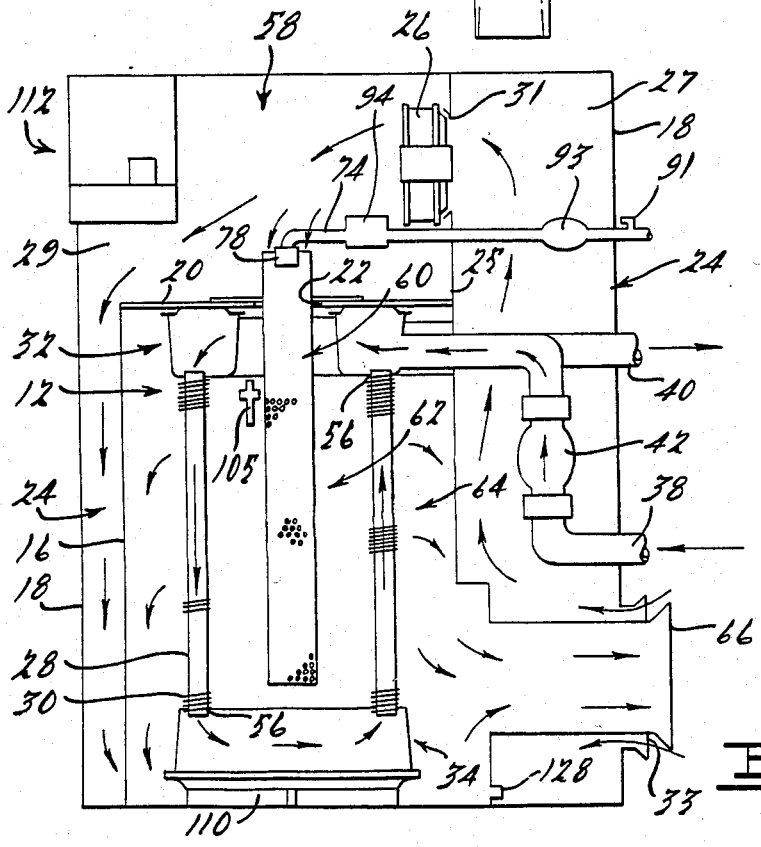

FIG. 5 shows a burner unit 120 which is a second embodiment of the burner assembly 14 of heater 10. Burner unit 120 is utilized for models of heater 10 having inputs of approximately 750,000 BTU per hour to approximately 1,000,000 BTU per hour. The features of burner unit 120 that differ from the burner assembly 14 shown in FIG. 3 (other than overall length) are the venturi portion, the orifice, and the distribution cone. Burner unit 120 has a venturi 122 that is generally cone-shaped in order to scoop more combustion air while eliminating venturi openings 102. Venturi 122 has an open top that is approximately 6 inches in diameter. Situated inside the open top of venturi 122 is a gas orifice 124 that comprises an orifice body 126 which is closed at its bottom and has a threaded orifice opening (not shown) on its top to which gas supply line 74 is attached. Orifice body in the preferred embodiment is approximately 1 inch high and has a diameter of approximately 3 inches. A plurality of orifice holes 130 are provided in a circumferential row near the downward end of orifice body 126. Orifice holes 130 like orifice apertures 100, differ in size and number depending on the particular type of input and gas fuel used. For example, in an embodiment of gas orifice 124 utilized in a 750,000 BTU/hour heater 10 that operates on natural gas, an orifice hole 130 is provided approximately every 30 degrees around orifice body 126 for a total of 12 orifice holes 130, each having a size corresponding approximately to a number 19 American drill size (which is approximately 0.166 inches in diameter). Like orifice 78, gas orifice 124 is supported in proper position within the open top of venturi 122 by a plurality of brackets 96 and a rim 97.

Figure 6:
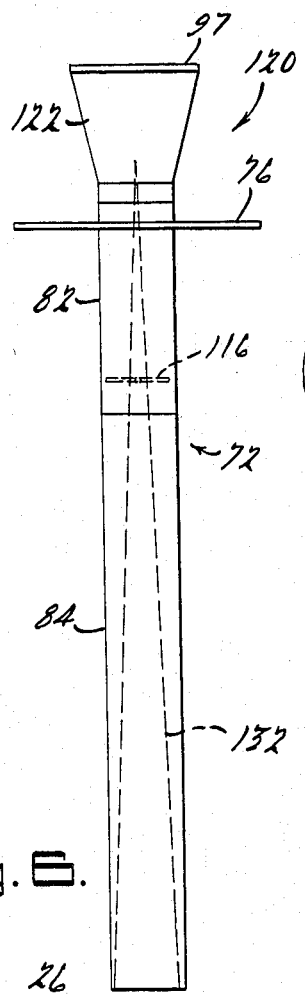
FIG. 6 is an elevational view of the burner shown in FIG. 5.

Burner unit 120 also has a distribution cone 132 inside its burner tube as shown in phantom in FIG. 6. The bottom diameter of distribution cone 132 is substantially equivalent to that of cone 114, however distribution cone 132 tapers to a point at its upper end. For a 750,000 BTU per hour heater 10, distribution cone 132 has a length of approximately 24 inches and for a 1,000,000 BTU per hour heater 10, distribution cone 132 has a length of approximately 34½ inches. Distribution cone 132, like cone 114, is provided near its upper end with a plurality of spacer pins 116 to maintain concentricity of distribution cone 132 with respect to burner tube 72.

It has been discovered that the optimum gap in combustion zone 62 between outer perforated tube 92 and heat exchanger tubes 28 is approximately 3½ inches. This gap has been found to be advantageous in preventing condensation of the flue products on tubes 28 given the above performance and characteristics of burner assembly 14. If the gap is substantially less than 3½ inches, fins 30 may burn due to excess heat from the burner and if the gap is substantially greater than 3½ inches, condensation may occur on tubes 28 because the temperature of the combustion byproducts at tubes 28 will be less than the dew point. In the preferred embodiment of heater 10, when water is flowing through tubes 28 at the design velocity of approximately eight feet per second, the temperature of the flue gases after passing around tubes 28 is approximately 300 degrees Fahrenheit which is above the dew point and therefore condensation on heat exchanger tubes 28 and/or fins 30 is substantially eliminated. The reduction of condensation on the exchanger tubes is desirable as it helps prevent corrosion of the tubes and enhances the useful life of heat exchanger unit 12. However, since the inside walls of inner sealed casing 16 are cooled by the fresh combustion air circulating in the forehearth 24, the flue gases upon coming into contact with the cooler inside walls, will condense thereon. A small step 110 is provided between lower header 34 of heat exchanger unit 12 and the floor of sealed casings 16 and 18 to position heat exchanger unit 12 higher within inner sealed casing 18. In this manner the condensation from any moisture in the combustion byproducts which forms on the inside walls of inner sealed casing 16 is allowed to collect underneath heat exchanger unit 12 while the flue gases are exited through flue outlet 66. A drain 128, shown in FIG. 9, is provided near the bottom of inner sealed casing 16 to remove the condensate when necessary.

First zone 58 between inner and outer sealed casings 16 and 18 is configured to supply adequate combustion air for various models of heater 10 which range in input from approximately 250,000 to 1,000,000 BTU per hour. A volume of of approximately 3.2 square feet for first zone 58 has been found to be adequate for the various heater 10 models. However, in order to supply the appropriate amount of combustion air for each BTU input level of heater 10, first zone 58 is pressurized by air intake means 26 in differing amounts. For example, first zone 58 for a 250,000 ; BTU heaters 10 is pressurized at approximately 0.6 inches WC. For heater 10 models with BTU per hour output levels of 500,000 BTU, 750,000 BTU and 1,000,000 BTU, first zone 58 is pressurized at approximately 0.8, 1.0, and 1.2 inches WC, respectively. These pressures in conjunction with the size of first perforations 88 and the net open area of burner portion 84 result in a minimum air/gas mixture velocity (after passing through the burner perforations) of 9.7 feet per second. This velocity (in conjunction with the parameters discussed above) enables combustion to take place without any flame touching the burner and thus prevents the burner from cracking due to excess temperature. This velocity also prevents the flame from flashing back into the burner and burning at the orifice because it is substantially greater than the velocity of the flame which is approximately one foot per second.

In the preferred embodiment of heater 10, heat exchanger unit 12 is comprised of twenty copper finned heat exchanger tubes 28. Tubes 28 are approximately one inch in diameter and integrally carry approximately seven fins 30 per lineal inch of tube. Fins 30 are aprpoximately one and seven eighths inches in diameter. Preferred burner assemblies 14 have a burner tube 72 with a diameter of approximately three and one half inches. Tubes 28 are situated in upper and lower headers 32 and 34 such that the fluid to be heated travels through a different bank of five tubes 28 a total of four times. For maximum heat exchange efficiency, slots 70 between baffles 68 measure approximately one half inch and baffles 68 extend the full length of the copper finned tubes 28. A liquid pump 42 capable of providing 75 gallons per minute of flow is used to provide the fluid velocity of eight feet per second through tubes 28 and prevent scaling that may result from hard water or the like.

As shown in FIG. 1, the front of inner sealed casing is provided with an inner front panel 117. The front of outer sealed casing 18 is provided with a control panel 112 and an outer front panel 118. Control panel 112 includes at least one capillary tube 113 that is connected to upper header 32 to sense the water temperature. Control panel 112 also includes a thermostat as well as the other controls referred to above to operate heater 10 in a safe and efficient manner. An example of such a control is a flow switch that proves fluid circulation through heat exchanger unit 12 prior to burner combustion. Completing outer sealed casing 18 is a corner panel 134 that provides access for additional controls if necessary.

Thus, there is described and shown in the above description, background, and drawings an improved water heater/boiler assembly which fully and effectively accomplishes the objectives thereof. However, it will be apparent that variations and modifications of the disclosed embodiment may be made without departing from the principles of the invention or the scope of the appended claims.

It is claimed:

1. A gas-fired burner tube for a water heater/boiler apparatus comprising an inner tube having a plurality of first perforations and an outer tube superimposed over said inner tube, said outer tube having a plurality of second perforations which are substantially larger than said first perforations, with more than one of said first perforations at least partially underlying each second perforation, said superimposed inner and outer tubes arranged to increase the thickness of said burner tube and to cover a portion of said first perforations.

2. A gas-fired burner tube as described in claim 1 wherein said first perforations all have a first size and are uniformly distributed throughout said inner tube.

3. A gas-fired burner tube as described in claim 2 wherein said second perforatons have a second size and are uniformly distributed throughout said outer tube.

4. A gas-fired burner tube as described in claim 3 wherein said first size is approximately 0.038 inches in diameter.

5. A gas-fired burner tube as described in claim 4 wherein said second size is approximately 0.265 inches in diameter.

6. A gas-fired burner tube as described in claim 5 wherein said first perforations give said inner tube an open area of approximately 45%.

7. A gas-fired burner tube as described in claim 6 wherein said second perforations give said outer tube an open area of approximately 65%.

8. A gas-fired burner tube as described in claim 7 wherein said burner tube has a net open area of approximately 29%.

9. A metal, tubular gas-fired burner for a water heater/boiler apparatus comprising an inner perforated tube and an outer perforated tube superimposed on said inner perforated tube, said inner perforated tube including a plurality of first perforations of uniform size and distribution thereby giving said inner perforated tube an open area of a first amount, said outer perforated tube comprising a plurality of second perforations of uniform size and distribution that are substantially larger than said first perforations, with more than one of said first perforations at least partially underlying each second perforation, said outer perforated tube having an open area of a second amount which is substantially greater than said first amount, and said outer perforated tube is superimposed over said inner perforated tube such that a portion of said first perforations are covered and said burner portion has a net open area that is less than said first amount.

10. A gas-fired burner as described in claim 9, wherein said uniform size of each of said first perforations is approximately 0.038 inches in diameter and said first amount is approximately 45%.

11. A gas-fired burner as described in claim 9, wherein said uniform size of each of said second perforations is approximately 0.265 inches in diameter and said second amount is approximately 65%.

12. A gas-fired burner as described in claim 9, wherein said net open area is approximately 29%.

13. A gas-fired burner as described in claim 9, further comprising a mixing portion connected to said perforated tubes, a venturi portion having an open top connected to said mixing portion, and an orifice supported in said open top, said orifice having a closed body and a circumferential row of orifice apertures in said body whereby when said orifice receives gas from a supply line said gas is introduced from said orifice apertures into said venturi portion of said burner.

14. A gas-fired burner as described in claim 13, further comprising a means for supporting said orifice in the center of said open top of said venturi portion of said burner.

15. A gas-fired burner as described in claim 14, further comprising a plurality of venturi openings in said venturi portion whereby when fresh combustion air enters said venturi portion through said open top or through said venturi openings a combustible mixture of air and gas is created in said venturi and said mixing portions.

* * * * *